United States Patent [19]

Rehkemper et al.

[11] Patent Number: 4,540,377

[45] Date of Patent: Sep. 10, 1985

[54] TOY VEHICLE CONVERSION ACCESSORY

[75] Inventors: Steven F. Rehkemper, Chicago; Steven P. Hanson, Winnetka; Harry Disko, S. Barrington, all of Ill.

[73] Assignee: Marvin Glass & Associates, Chicago, Ill.

[21] Appl. No.: 575,790

[22] Filed: Feb. 1, 1984

[51] Int. Cl.[3] ..... A63H 29/00; A63H 17/05

[52] U.S. Cl. ..... 446/430; 446/465; 446/434

[58] Field of Search ..... 446/465, 469, 470, 471, 446/431, 434, 435, 448, 457, 459, 462, 464, 429, 430; 180/198; 414/537

[56] References Cited

U.S. PATENT DOCUMENTS

| | | | |
|---|---|---|---|
| 1,371,819 | 3/1921 | Smith | 180/198 |
| 3,306,175 | 2/1967 | Ferwerda | 180/198 X |
| 3,913,934 | 10/1975 | Koehn et al. | 414/537 X |
| 4,061,339 | 12/1977 | Coster | 446/471 X |
| 4,188,748 | 2/1980 | Rich et al. | 446/430 |
| 4,345,402 | 8/1982 | Hanson et al. | 446/430 |

*Primary Examiner*—Mickey Yu

*Attorney, Agent, or Firm*—John S. Pacocha

[57] ABSTRACT

A 4×4 conversion accessory for vehicles including a pair of spaced apart axles secured to an elongated transverse central frame member. Relatively large lugged wheels are attached to the ends of each axle for rotation with respect to the frame member. Mounting wells for releasably receiving the wheels of the vehicle are carried by the axles adjacent each lugged wheel to support the vehicle on the conversion accessory. Each well has a substantially solid outer circular wall and a spaced apart inner circular wall with a generally vertical slot extending down below the center of the inner wall. A telescoping frame member and mounting wells carried for sliding movement along the transverse axles accommodate vehicles having different wheel bases. In another version, the elongated frame member includes a compressible spring and releasable actuator for propelling a combined vehicle and 4×4 converter accessory.

10 Claims, 14 Drawing Figures

TOY VEHICLE CONVERSION ACCESSORY

BACKGROUND OF THE INVENTION

1. Field of the Invention

This invention relates generally to toy vehicle accessories and more particularly to a 4×4 conversion accessory for miniature vehicles.

2. Background Art

Miniature vehicles such as die cast cars of a scale of approximately 1 to 50 or 1 to 60, in a variety of body styles, are popular toys. Recently, converted vehicles with large, oversized, wheels having large treads or lugs, 4 wheel drive, heavy duty suspensions and powerful motors, have become popular adult "toys" commonly referred to as "4×4"s. Such converted vehicles generally have a conventional body that is spaced from the road surface to provide additional clearance for rough terrain. While it would of course be possible to make miniature vehicles styled after the popular 4×4 vehicles in a conventional manner, a conversion accessory that would permit a more conventional miniature die cast car or other vehicle to be converted into a 4×4 vehicle would provide additional play in the conversion as well as in either the conventional or 4×4 mode.

SUMMARY OF THE INVENTION

The present invention is concerned with providing a 4×4 conversion accessory for miniature vehicles such as die cast cars. These and other objects and advantages of the invention are achieved by a pair of spaced axles secured to a transverse elongated central frame member with a pair of large lugged wheels attached to the end of each axle for rotation with respect to the frame. Adjacent each lugged wheel a mounting well for releasably receiving the wheels of die cast cars is carried by the axle to support the die cast car on the conversion accessory. Each mounting well has a pair of spaced apart outer and inner circular walls. The outer wall is substantially solid while the inner wall has a generally vertical slot extending down below the center of the inner wall. In order to accommodate vehicles of different wheel bases, the frame member may telescope and the mounting wells may be carried for sliding movement along the transverse axle. In a propelled version, the elongated frame member includes a compressible spring and releasable actuator for propelling the combined miniature vehicle and 4×4 conversion accessory along a playing surface.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
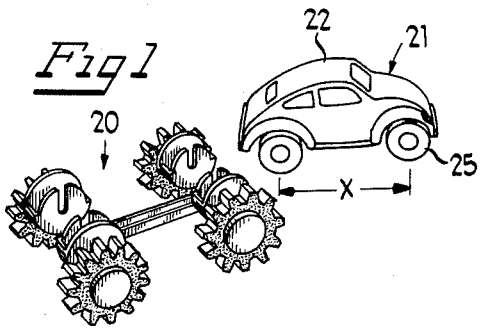
FIG. 1 is a perspective view of one embodiment of the present invention.
Figure 2:
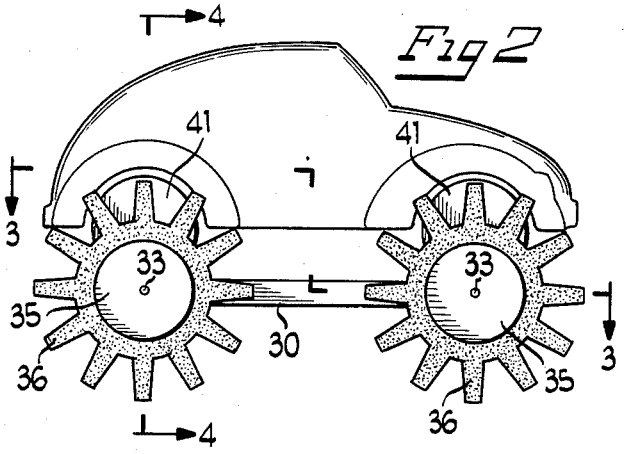
FIG. 2 is an enlarged scale, side elevational view showing the car and the accessory of FIG. 1 in combination.
Figure 3:
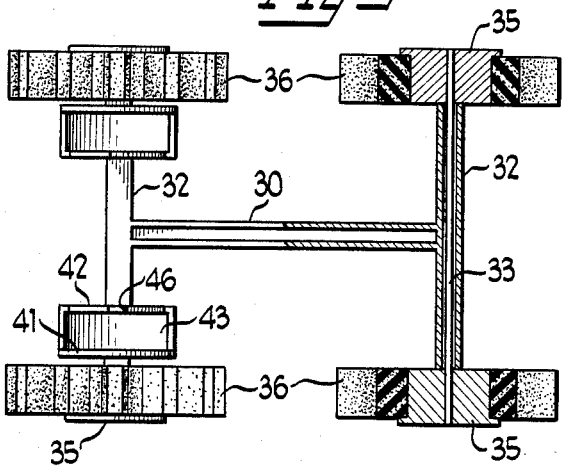
FIG. 3 is a sectional view taken generally along the line 3—3 of FIG. 2.
Figure 4:
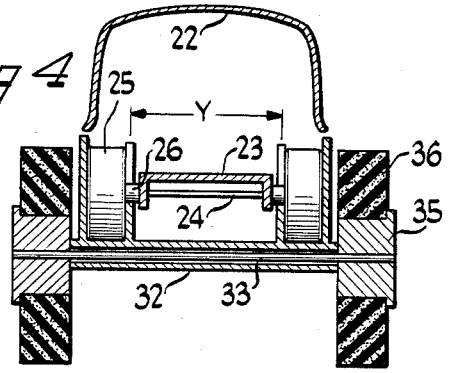
FIG. 4 is a sectional view taken generally along the line 4—4 of FIG. 2.
Figure 5:
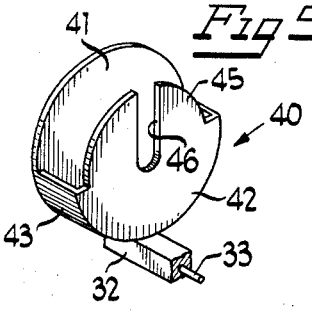
FIG. 5 is an enlarged scale, perspective view of the mounting well of the accessory shown in FIGS. 1–4.
Figure 6:
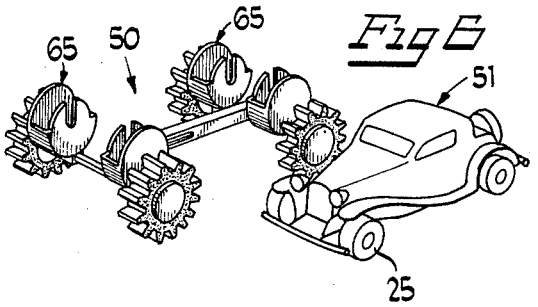
FIG. 6 is a perspective view of an alternative embodiment of the present invention.
Figure 7:
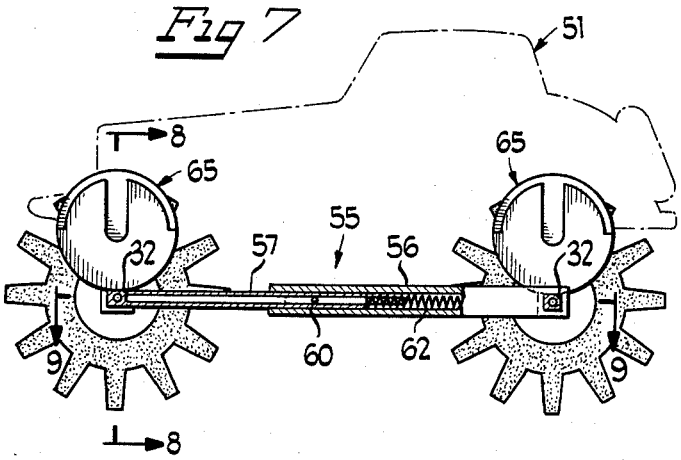
FIG. 7 is an enlarged scale, generally vertical center sectional view of the accessory shown in FIG. 6 with the car in phantom.
Figure 8:
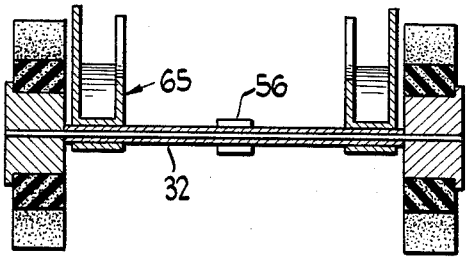
FIG. 8 is a sectional view taken generally along the line 8—8 of FIG. 7.
Figure 9:
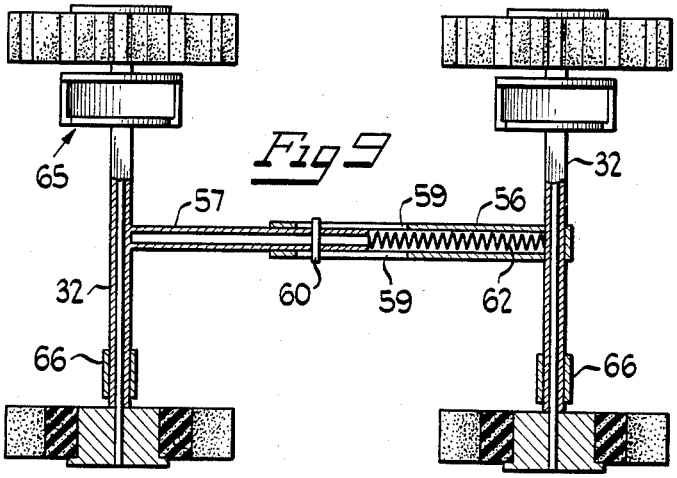
FIG. 9 is a sectional view taken generally along the line 9—9 of FIG. 7.

Referring now to the drawings in which like parts are designated by like reference characters throughout the several views, there is shown in FIG. 1 a 4×4 converter accessory 20 for a miniature die cast car 21.

Generally the embodiment shown in FIGS. 1 through 5 may be used with any miniature vehicle having a wheel base where the centers of the front and rear axles are spaced apart a distance "X" and the wheels on each axle are spaced apart a distance "Y". While there is of course some tolerance in the "X" and "Y" dimensions, it is generally only a percentage of the dimension. Usually the miniature vehicles, particularly the die cast vehicles, have a body 22 secured atop a chassis 23 carrying a pair of spaced apart axles 24 with a freely rotating wheel 25 mounted on each end of each axle. The size of the miniature vehicle's wheels are relatively standardized, and differences in either wheel thickness or radial height may be sufficiently accommodated to permit use of the accessory with a number of different miniature vehicles having the required wheel base dimensions. Oftentimes the wheels 25 include an inwardly projecting hub 26 that fits onto the axle 23.

Conversion accessory 20 has an elongated central frame member 30. A pair of spaced apart transverse tubular axles 32 are secured at each end of the elongated frame member. Each tubular axle 32 receives a shaft 33 that is longer than the axle itself and of a diameter smaller than the inner diameter of the axle 32 so that the shaft 33 may freely rotate within the tubular axle 32. Mounted at each end of each of the axle shafts 33, in any one of a number of conventional ways, is a hub 35 which rotates relative to the shaft. Secured around each hub 35, generally by the inherent resiliency of the material, is a large lugged or treaded tire 36. Thus, as described thus far the 4×4 conversion accessory 20 comprises a free-wheeling carriage.

Carried atop the axles 32 are wheel mounting wells 40. One of the wells is adjacent but spaced inboard of each large lugged wheel 36. Each mounting well 40 has an outer, substantially solid circular wall 41 and a spaced apart inner, generally circular wall 42. The lower semi-circular portions of the walls 41 and 42 are joined together by a cylindrical peripheral wall 43. Walls 41 and 42 are spaced apart a distance sufficient to accommodate a range of thicknesses of miniature car wheels 25.

While the lower portions or peripheries of the walls 41 and 42 are substantially equal, the inner wall 42 is cut back or recessed in along the upper periphery 45. Extending down from the upper periphery 45 is a generally vertical slot 46 that extends down below the center of the inner circular wall 42. Slot 46 is wide enough to receive a hub 26 but may also of course receive the smaller diameter axle 24 of the miniature car. In this embodiment, each wheel mounting well 40 is secured to a transverse axle 32 or may be formed as an integral part of the axle 32. Thus, the wheels 25 of the miniature car 21 are received within the well 40 to releasably retain the vehicle 21 on the 4×4 conversion accessory 20 permitting the child to convert a conventional miniature vehicle into a 4×4 and then play with the 4×4 conversion. The substantially solid outer circular wall 41 masks the small wheels of the miniature car.

As an alternative to the fixed wheel base conversion accessory 20, an adjustable 4×4 converter 50 is shown in FIGS. 6–10. Again a miniature car 51 is shown which is similar in construction to the car 21 but has a different body style. The central elongated frame 55 is formed of two telescoping pieces 56 and 57. Conveniently the larger, hollow, rear piece 56 includes slots 59 in the side walls in which a cross pin 60 carried by the smaller forward piece 57 rides. A compressible coil spring 62 with the piece 56 urges the captured piece 57 to the furthest extension of the telescoping frame 55 as limited by the cross pin 60 engaging one end of the slot 59. Alternatively, the pieces 56 and 57 may be compressed together against the bias of the spring 62 until the cross pin 60 abuts the other end of the slots 59.

Figure 10:
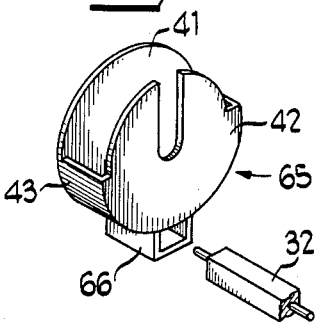
FIG. 10 is an enlarged scale, perspective view of the mounting socket of the accessory shown in FIGS. 6–9.
Figure 11:
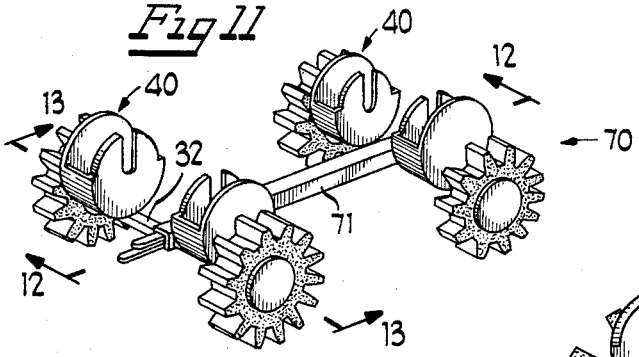
FIG. 11 is a perspective view of yet another embodiment of the present invention.
Figure 12:
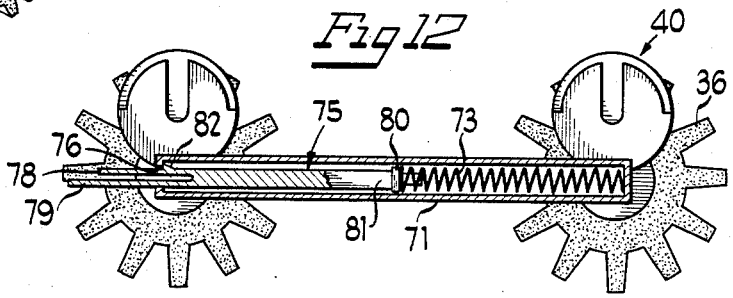
FIG. 12 is an enlarged scale, sectional view taken generally along the line 12—12 of FIG. 11.
Figure 13:
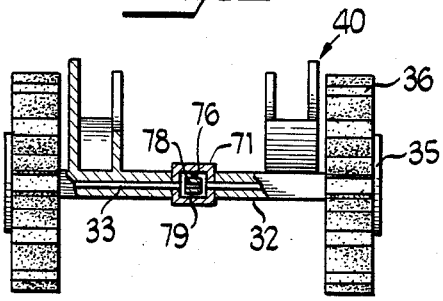
FIG. 13 is an enlarged sectional view taken generally along the line 13—13 of FIG. 11.
Figure 14:
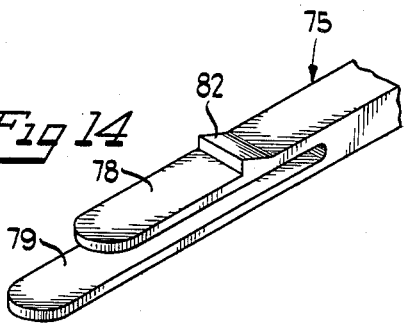
FIG. 14 is an enlarged scale perspective view of a portion of the actuator shown in FIGS. 11–13.

In addition to the telescoping elongated central frame member, the spacing between the pairs of mounting wells on a transverse axle is adjustable in this alternative embodiment. The transverse axles, shafts, wheel hubs, and large lugged tires are substantially the same in this embodiment as in the embodiment shown in FIGS. 1 through 5. Wheel mounting wells 65 of this embodiment are somewhat similar to the mounting wells 40 insofar as the outer, inner, and peripheral walls 41, 42 and 43, respectively. However, rather than being secured to the axles 32 in a fixed position, the mounting wells 65 are carried for sliding movement along the axles. For this purpose, as is best shown in FIG. 10, the wells 65 have a sleeve 66 that fits over the axles 32 for sliding movement thereon secured to the underside of the well.

Thus, a substantially wider range of miniature vehicle bases may be accommodated in the adjustable 4×4 converter accessory of the alternative embodiment shown in FIGS. 6–10. When a vehicle, such as 51, is placed with the wheels 25 of the vehicle seated within the slidably adjustable walls 65, the extension of the telescoping frame 55 is fixed against the bias of the spring 62. The continued urging of the frame 55 to a more extended position helps retain the vehicle 61 combined with the accessory 50.

A propelled version 70 of the 4×4 converter accessory is shown in FIGS. 11–14. The large lugged wheels 36, the hubs 35, the shafts 33, and the transverse axles 32 are substantially the same as in FIGS. 1–5. In addition, the wheel mounting wells 40 are the same as those used in the first embodiment. However, the elongated frame member 71 is hollow and contains a compressible coil spring 73 plus an actuator 75.

At the back end of the frame member 71 there is an opening 76 through which compressible spaced apart tabs or leaves 78 and 79, which form a trigger end of the actuator 75, protrude. A plug 80 with an enlarged head that is larger than the opening 76 is inserted into the coil spring 73. The head of the plug 80 is engaged by the forward end 81 of the actuator 75. On the shorter upper leaf 70 there is a projecting catch 82 which is engagable with part of the frame member 71 adjacent the opening 76 when the spring 73 is compressed. Actuator 75 is made of a relatively resilient plastic material so that the upper tab 78 may be squeezed down toward the longer lower tab 79 by a child's fingers. Once the catch 82 is sufficiently depressed to disengage the catch from the frame member, the compressed coil spring 73 pushes the actuator 75 out the opening 76. In reaction to the thrust of the released compressed spring 73, a vehicle combined with the 4×4 converter 70 will be propelled forwardly along the playing surface.

While particular embodiments of the present invention have been shown and described, additional changes and modifications will occur to those skilled in the art. It is intended in the following claims to cover all such changes and modifications as fall within the true spirit and scope of the present invention.

What is claimed as new and desired to be secured by Letters Patent is:

1. A toy vehicle conversion accessory for a toy vehicle having relatively small wheels comprising:

an elongated frame member having opposed ends;

a pair of spaced apart transverse axles secured to the elongated central frame member adjacent each end;

a pair of relatively large wheels mounted for rotation on each of the axles; and mounting wells carried on the axle adjacent each of the relatively large wheels for releasably receiving and masking the relatively small wheels of the toy vehicle to combine the toy vehicle with the accessory for movement therewith along a playing surface.

2. The toy vehicle conversion accessory of claim 1 in which:

each of the mounting wells has an outer wall and a spaced apart inner wall; and the spaced apart inner wall has a slot generally centrally vertically disposed and extending from the top of the inner wall down below the center of the inner wall.

3. The toy vehicle accessory of claim 2 in which the outer wall is a substantially solid circular piece.

4. The toy vehicle accessory of claim 1 in which the wheel mounting wells are carried for sliding movement along the transverse axles.

5. The toy vehicle conversion accessory of claim 1 in which the elongated central frame member is two relatively telescoping parts.

6. The toy vehicle conversion accessory of claim 5 in which one of the telescoping parts is captured by the other part.

7. A toy vehicle conversion accessory for a toy vehicle having relatively small wheels comprising:

an elongated frame member having opposed ends;

a pair of spaced apart transverse axles secured to the elongated central frame member adjacent each end;

a pair of relatively large wheels mounted for rotation on each of the axles;

mounting wells carried on the axle adjacent each of the relatively large wheels for releasably receiving the relatively small wheels of the toy vehicle to combine the toy vehicle with the accessory for movement therewith along a playing surface;

the elongated central frame member being hollow and having an opening at one end;

a compressible biasing means for propelling the combined toy vehicle and the accessory contained within the elongated frame member; and an actuator for compressing and releasing the biasing means insertable into the hollow member with a trigger portion of the actuator protruding from the opening.

8. The toy vehicle conversion acessory of claim 7 in which the protruding trigger comprises a pair of spaced apart compressible leaves.

9. The toy vehicle conversion accessory of claim 8 in which one of the leaves has a projecting catch that engages an edge forming the opening.

10. The toy vehicle conversion accessory of claim 3 in which:

the inner wall is generally circular; and the lower semicircular portions of the outer wall and the inner wall are joined together by a cylindrical peripheral wall.

* * * * *